US009729951B2

(12) United States Patent
Wolf et al.

(10) Patent No.: US 9,729,951 B2
(45) Date of Patent: Aug. 8, 2017

(54) LOUDSPEAKER OVERLOAD PROTECTION

(71) Applicant: Harman Becker Automotive Systems GmbH, Karlsbad (DE)

(72) Inventors: Florian Wolf, Regensburg (DE); Peter Perzlmaier, Regensburg (DE); Leander Scholz, Salching (DE); Markus Christoph, Straubing (DE); Georg Spielbauer, Haselbach (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 420 days.

(21) Appl. No.: 13/774,529

(22) Filed: Feb. 22, 2013

(65) Prior Publication Data

US 2013/0216049 A1 Aug. 22, 2013

(30) Foreign Application Priority Data

Feb. 22, 2012 (EP) ..... 12156566

(51) Int. Cl.
*H04R 1/00* (2006.01)
*H04R 3/00* (2006.01)

(52) U.S. Cl.
CPC ..... *H04R 1/00* (2013.01); *H04R 3/007* (2013.01)

(58) Field of Classification Search
CPC ..... H04R 1/00; H04R 3/007
See application file for complete search history.

(56) References Cited

U.S. PATENT DOCUMENTS 3,991,370 A * 11/1976 Pate ..... H03G 3/3005 327/309
5,255,324 A * 10/1993 Brewer et al. ..... 381/107
2002/0167354 A1 11/2002 Stanley
2004/0176955 A1* 9/2004 Farinelli et al. ..... 704/255
(Continued)

FOREIGN PATENT DOCUMENTS

JP 2005286546 10/2005
WO 02089460 11/2002

OTHER PUBLICATIONS

Extended European Search Report for corresponding Application No. 12156566.7, dated Jun. 4, 2012, 12 pages.
(Continued)

*Primary Examiner* — Ping Lee
(74) *Attorney, Agent, or Firm* — Brooks Kushman P.C.

(57) ABSTRACT

A loudspeaker overload protection circuit and method receives at a compressor a signal representing the estimated loudspeaker power consumption; receives at the compressor a signal representing the nominal power of the loudspeaker; receives at the compressor an input audio signal from the signal source and supplying with the compressor an output audio signal to the loudspeaker; estimates from the output audio signal, (a) signal(s) that represent(s) the voltage and/or current supplied to the loudspeaker and a parameter that represents the ohmic resistance of the loudspeaker the power consumed by the loudspeaker; supplies a signal representing the estimated loudspeaker power consumption to the compressor; and attenuates the input audio signal when the signal representing the estimated loudspeaker power consumption exceeds the signal representing the nominal power of the loudspeaker.

11 Claims, 2 Drawing Sheets

(56) References Cited

U.S. PATENT DOCUMENTS

| | | | | |
|---|---|---|---|---|
| 2010/0128904 | A1* | 5/2010 | Hanna | H03G 3/3005 381/107 |
| 2010/0158259 | A1 | 6/2010 | Hanna et al. | |
| 2011/0228945 | A1 | 9/2011 | Mihelich et al. | |

OTHER PUBLICATIONS

European Office Action for corresponding Application No. 12156566.7, dated Jul. 22, 2014, 5 pages.

* cited by examiner

LOUDSPEAKER OVERLOAD PROTECTION

1. CLAIM OF PRIORITY

This patent application claims priority from EP Application No. 12 156 566.7-2225 filed Feb. 22, 2012, which is hereby incorporated by reference.

2. FIELD OF TECHNOLOGY

This invention relates to a circuit and method for protecting loudspeakers, and more particularly to sensing an overload condition in the input signal of a loudspeaker and limiting input signal accordingly.

3. RELATED ART

In recent years switched audio amplifiers employing pulse width modulation (PWM) have become increasingly popular because they provide high power output with little heat dissipation so that even amplifiers with small dimensions can provide high levels of power for common loudspeakers. In order to avoid damages to the loudspeakers caused by the increased power supplied to them, limiters are used that limit the power to a tolerable value. However, limiting the power deteriorates the acoustic performance of the audio system (amplifier loudspeaker system) by, e.g., generating harmonic and non-harmonic distortions or by compressing the sound perceived by a listener to an unpleasant extent. Limiters are known that try to overcome these negative effects by using sophisticated models of the loud-speaker for the prediction of the loudspeaker behavior so that the power level is adapted almost inaudibly. However, such limiters are often complex and require a great amount of detailed data of the loudspeaker for its modeling and, thus, are costly and difficult to implement. Simple systems, in contrast, often deteriorate the acoustic performance of the system to an unacceptable extent.

There is a need for a simple loudspeaker overload protection technique that provides improved acoustic performance.

SUMMARY OF THE INVENTION

According to one aspect, a loudspeaker overload protection circuit comprises a compressor that is connected between a signal source and a loudspeaker; the compressor having a first input for receiving an input audio signal, a second input for receiving a signal representing the estimated loudspeaker power consumption, a third input for receiving a signal representing the nominal power of the loudspeaker; an output for providing an output audio signal; and a power estimator connected in a feedback loop between the output and the second input of the compressor to estimate, from the compressor output audio signal, the power consumed by the loudspeaker; the power estimator receiving (a) signal(s) that represent(s) the voltage and/or current supplied to the loudspeaker and a parameter representing the ohmic resistance of the loudspeaker. The power estimator is configured to calculate, from the signal(s) that represent(s) the voltage and/or current supplied to the loudspeaker and/or a parameter rep-resenting the ohmic resistance of the loudspeaker, the power consumed by the loudspeaker, and to supply a signal representing the estimated loudspeaker power consumption to the compressor. The compressor attenuates its input audio signal when the signal representing the estimated loudspeaker power consumption exceeds a given limit.

According to another aspect, a loudspeaker overload protection method comprises receiving at a compressor a signal representing estimated loudspeaker power consumption; receiving at the compressor a signal representing the nominal power of a loudspeaker; receiving at the compressor an input audio signal from a signal source and supplying with the compressor an output audio signal to the loudspeaker; estimating, from the output audio signal (a) signal(s) that represent(s) the voltage and/or current supplied to the loudspeaker and a parameter that represents the ohmic resistance of the loudspeaker, the power consumed by the loudspeaker, thereby providing the signal representing the estimated loudspeaker power consumption; and attenuating with the compressor the input audio signal when the signal representing the estimated loudspeaker power consumption exceeds the signal representing the nominal power of the loudspeaker.

These and other objects, features and advantages of the present invention will become apparent in light of the detailed description of the embodiments thereof, as illustrated in the accompanying drawings. In the figures, like reference numerals designate corresponding parts.

DESCRIPTION OF THE DRAWINGS

Various specific embodiments are described in more detail below based on the exemplary embodiments shown in the figures of the drawing. Unless stated otherwise, similar or identical components are labeled in all of the figures with the same reference numbers.

DETAILED DESCRIPTION OF THE INVENTION

Figure 1:
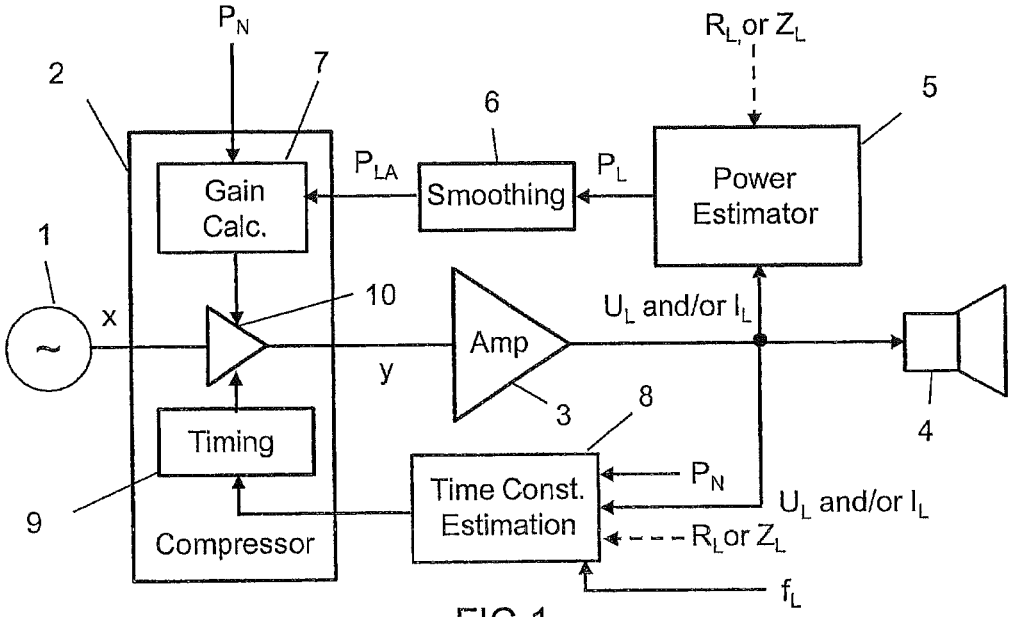
FIG. 1 is a block diagram schematically illustrating the basic operation of the improved loudspeaker overload protection circuit.

Referring now to FIG. 1, the basic operation of the improved loudspeaker overload protection circuit is schematically illustrated. An audio signal source 1 provides an audio signal x to a compressor 2, where it is processed and output as signal y to, e.g., a power amplifier 3 that supplies the amplified audio signal to a loudspeaker 4. Dynamic range compression, also called DRC or simply compression reduces the volume of loud sounds (or amplifies quiet sounds) by narrowing or "compressing" an audio signal's dynamic range. The dedicated electronic hardware unit or audio software used to apply compression is called a compressor. Compressors often have attack and release controls that vary the rate at which compression is applied and smooth the effect. A limiter is a circuit that allows signals below a specified input power to pass unaffected while attenuating the peaks of stronger signals that exceed this input power to a given value. It is, thus, a special type of compressor, as explained in more detail below.

The signal voltage or current or power, which is the product of the voltage and the current, supplied to the loudspeaker 4 is estimated/calculated/measured by a power estimator 5 that also receives a signal representing the ohmic (DC) resistance $R_L$ or its frequency dependant impedance $Z(\omega)$ of the (e.g., voice coil of the) loudspeaker 4. From the voltage $U_L$ and/or current $I_L$ supplied to loudspeaker 4 and the resistance $R_L$ or the impedance $Z(\omega)$ of the loudspeaker 4 the power consumption of the loudspeaker 4 is estimated in the power estimator 5, resulting in a time dependant output signal $P_L$ representing the estimated power that is supplied to a smoothing filter 6 where it is, e.g., low-pass filtered, to supply a signal $P_{LA}$ representing the average estimated power consumed by the loudspeaker 4.

The compressor 2 also receives a signal $P_N$ representing the nominal power, i.e., the power that the loudspeaker can withstand permanently without being damaged. This signal $P_N$ forms a threshold $T_1$ for the compressor 2, with which the estimated power representing the actual power received by the loudspeaker 4 is compared. The compressor 2 includes, e.g., a gain calculator 7 that calculates from the signals $P_N$ and $P_{LA}$ the gain of a controllable amplifier 10 that forms part of the path from the source 1 to the loudspeaker 4 and that may be a simple comparator if the compressor is operated as a limiter.

The circuit including the compressor 2, the power estimator 5 and the smoothing filter 6 form a compressor/limiter system in which not all power levels that exceed the threshold $T_1$ are considered for the compression factor. Peak values are not relevant in this regard and are usually not harmful for common loudspeakers, but are important for the acoustic behavior, especially at low frequencies (e.g., as kick bass). However, certain loudspeakers (e.g., tweeters) are more sensitive to short term excessive signals in terms of damage and distortion than others (e.g., subwoofers), thus an additional circuit may be used that includes a time constant estimator 8 and timing control unit 9 that may be arranged in the compressor 2. The time constant estimator 8 addresses peak powers that may damage, e.g., "burn", the voice coil of the loudspeaker 4 by, e.g., estimating the current through the voice coil of the loudspeaker 4 in view of the signal's time structure and the loudspeaker to be protected. In order to prevent damage as much as possible but keep deteriorations of the sound perceived by the listener as small as possible, the time constants may further be adaptive, i.e., signal dependent as described below in connection with FIG. 3.

The power represented by the signal $P_L$ and the voice coil current represented by $I_L$ may be estimated as follows:

$$P_L=U_L^2/R_L \text{ or}$$

$$P_L=I_L^2\cdot R_L \text{ or}$$

$$P_L=I_L\cdot U_L.$$

where $U_L=g\cdot y$ with g being the gain of amplifier 3. Thus, the power estimator 5 and/or the timing unit 9 may be supplied with the signal y instead of the voltage $U_L$, if the gain g is known.

The time constant estimator 8 receives the nominal power $P_N$, the amplifier output current $I_L$ and/or the output voltage $U_L$, the voice coil ohmic (DC) resistance $R_L$ or the impedance $Z(\omega)$, and a lower critical frequency $f_L$. From these it estimates, e.g., time constants representing optimum attack and release times for a certain type of loudspeaker; the loudspeaker being identified by the lower critical frequency $f_L$ and the nominal power $P_N$. The lower critical frequency $f_L$ may be substituted by a less accurate range identifier for, e.g., woofer, midrange speaker or tweeter. The time constant for an optimum attack time is then supplied to the compressor 2 that seeks to adjust/adapt the actual attack and release time dependent on the audio signal. The nominal Power $P_N$, the voice coil ohmic (DC) resistance $R_L$, which both can be determined or may be taken from a data sheet, may be stored in a memory or manually adjusted, e.g., using a potentiometer. The time constant estimator 8 may be a signal processing unit that processes the signal y according to a given function or a table stored in memory.

Figure 2:
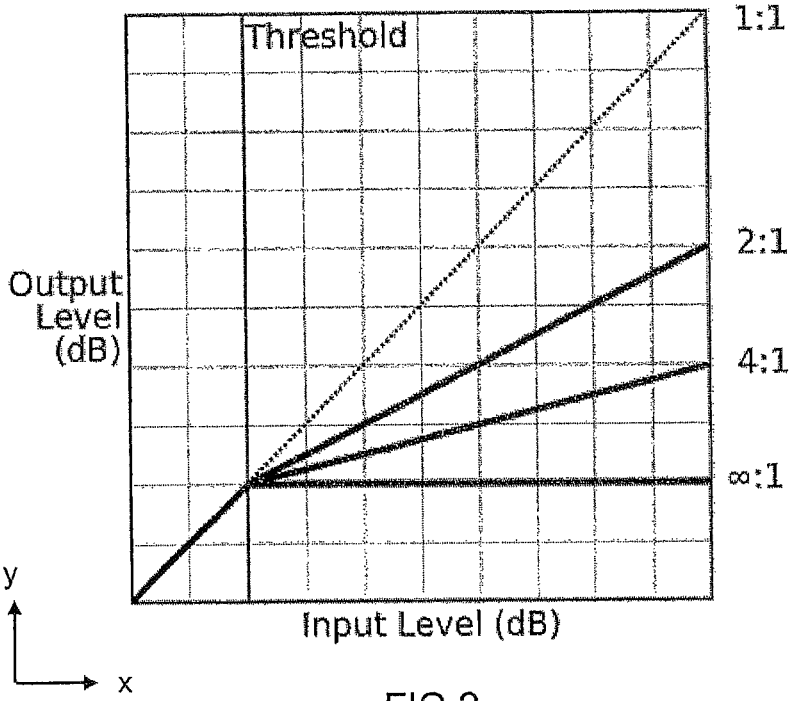
FIG. 2 is a diagram illustrating the static transfer characteristic of a compressor.

As illustrated in FIG. 2, a compressor reduces the level of an audio signal if its amplitude exceeds a certain threshold. It is commonly set in dB, where a lower threshold means a larger portion of the signal will be treated compared to a higher threshold. The amount of gain reduction is determined by ratio. A ratio of M:1 means that if the input level is M dB over the threshold, the output signal level will be 1 dB over the threshold. The highest ratio of ∞:1 is known as 'limiting'. It is commonly achieved using a ratio of 60:1 and effectively denotes that any signal above the threshold will be brought down to the threshold level except briefly after a sudden increase in input loudness, known as an "attack".

The speed with which a compressor acts might be controlled to a certain degree. The 'attack phase' is the period during which the compressor decreases gain to reach the level that is determined by the ratio. The 'release phase' is the period during which the compressor increases gain to the level determined by the ratio, or, to zero dB, once the level has fallen below the threshold. The length of each period is determined by the rate of change and the required change in gain. For more intuitive operation, a compressor's attack and release controls are labeled as a unit of time. This is the amount of time it will take for the gain to change a set amount of dB. For example, if the compressor's time constants are referenced to 10 dB, and the attack time is set to 1 ms, it will take 1 ms for the gain to decrease by 10 dB, and 2 ms to decrease by 20 dB.

In contrast to common compressors where the attack and release times are adjustable by the user, the compressor used in the present circuit may have the attack and release times determined by an adaptive circuit design in which the attack and/or release times change depending on the signal and the type of loudspeaker to be protected.

Figure 3:
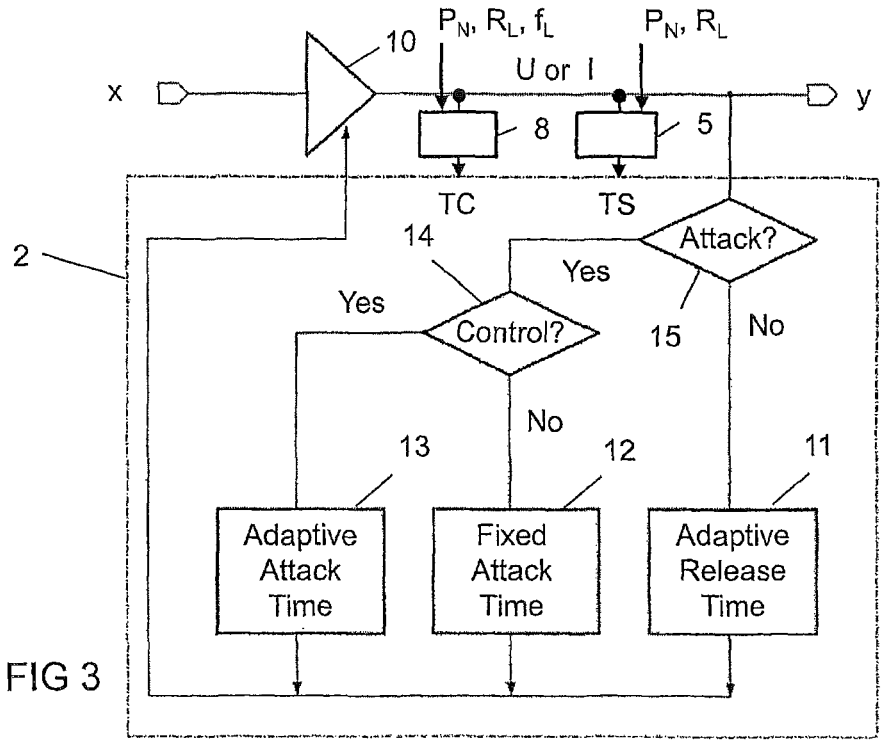
FIG. 3 is a bock diagram illustrating a timing circuit that may be used in the circuit of FIG. 1.

The apparatus and method described below with reference to FIG. 3 achieve this, based on a (compressor) threshold TS derived from the estimated power by the power estimator 5 and from at least one estimated (compressor) time constant TC provided by the time constant estimator 8 and using a suitable combination of both fixed and adaptive characteristic curves for the parameters attack time $t_A$ and release time $t_R$ of the compressor 2. The system shown in FIG. 3 comprises the controllable amplifier 10 receiving the input signal x and providing the output signal y. A feedback network in the compressor 2 establishes three modes of operation, in which the actual mode depends on the level of the output signal y. The modes of operation may be determined in step 15 by comparing the level of the output signal y with a threshold level $T_2$. If the signal level is below the threshold level $T_2$ the feedback circuit enters the release state, otherwise it enters the attack state.

In the release state the release parameters (e.g., release time, release factor, release increment) are calculated adaptively dependent on the threshold level and the signal level or the value of the "undershot" of the threshold $T_2$. Thus an adaptive gain control characteristic 11 is achieved.

In the attack state the attack parameters (e.g., attack time, attack factor, etc.) can be either calculated adaptively dependent on the threshold level $T_2$ and the signal level 12, or a fixed control characteristic 13, can be used. The decision to whether to use fixed or adaptive gain control in the attack state is taken in step 14, for example, in accordance with the extent to which the threshold level $T_2$ is exceeded by the output signal level or on the basis of the frequency spectrum of the input signal, but is not restricted to these two criteria. Alternatively, the input signal may be evaluated for this decision.

An adaptive gain control characteristic is appropriate for small excess values of the input signal over the threshold level $T_2$. The fixed gain control characteristic is appropriate for high excess values of the input signal over the threshold level $T_2$. While the fixed characteristic is rather insensitive to volume pumping, the adaptive characteristic regulates the volume more slowly when the input signal approaches the threshold level. This prevents the feedback network in the timing unit 9 from switching between attack and release modes too often, which is irritating for the listener and would destabilize the overall system.

Other advantages regarding the reduction of artifacts can be obtained by cascading identical compressors with different parameters for the attack time, for example, or by cascading different compressors or a combination of identical and different compressors with correspondingly selected parameters. The corresponding blocks 11-13 shown in FIG. 3 for adaptive release, fixed attack and adaptive attack can also be designed in cascaded form.

Further advantages regarding elimination of artifacts can be achieved using so-called band division, that is, separate processing of different frequency ranges of the audio signal by identical limiters/compressors with different parameters or by a combination of identical and different limiters/compressors with appropriately selected parameters. Dual-band and tri-band divisions can be used in this respect, for example. The corresponding signal processing blocks in FIG. 3 (e.g., adaptive release, fixed attack and adaptive attack) can likewise be carried out using band division.

A method for overload protection may employ a compressor (dependent on the compression ratio, also called limiter) that comprises a controlled amplifier having an input terminal, an output terminal and a control terminal for controlling the gain of the controlled amplifier, a feedback network connecting the output terminal and the control terminal of the controlled amplifier for determining the gain control characteristic, the feedback network having a first mode (attack) of operation and a second mode (release) of operation for controlling the gain of the controlled amplifier, in which the feedback network is adapted for controlling the gain using an adaptive control characteristic in the first mode of operation and adapted for controlling the gain using a fixed control characteristic or an adapted control characteristic dependent on the level of an output signal provided by the output terminal in the second mode of operation. The adaptive control characteristic is dependent on the level of an input signal received by the input terminal.

Accordingly, the compressor receives a signal representing the estimated loudspeaker power consumption, a signal representing the nominal power of the loudspeaker; and an input audio signal from the signal source. It supplies an output audio signal to the loudspeaker. The power estimator estimates from the output audio signal, from (a) signal(s) that represent(s) the voltage and/or current supplied to the loudspeaker and from a parameter that represents the ohmic resistance of the loudspeaker the power consumed by the loudspeaker, thereby providing the signal representing the estimated loudspeaker power consumption. The compressor attenuates the input audio signal when the signal representing the estimated loudspeaker power consumption exceeds the signal representing the nominal power of the loudspeaker.

The circuit and method described above in connection with FIGS. 1 and 3 may be implemented in analog circuitry, digital circuitry or a blend of both. The implementation as an algorithm in a digital signal processor (DSP) provides the necessary flexibility to realize the discussed combinations and selection of suitable parameters.

Figure 4:
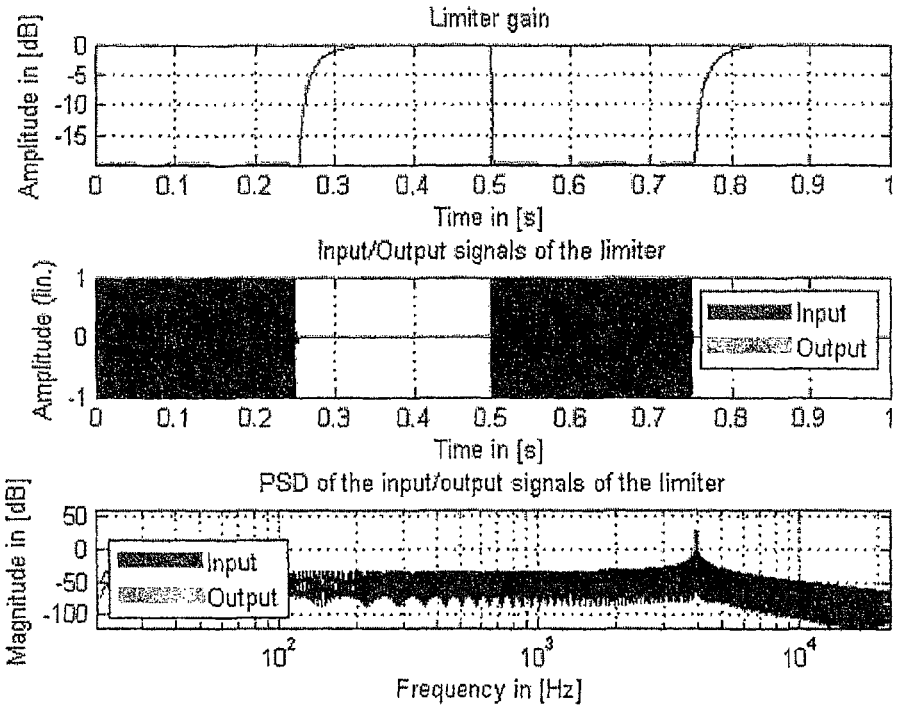
FIG. 4 is a diagram illustrating the compressor (limiter) gain over time and the power spectral density of the compressor in the circuit of FIG. 1.

FIG. 4 illustrates the compressor (limiter) gain over time and the power spectral density of the compressor 2 in the circuit of FIG. 1 when a pulsed 4 kHz signal is supplied to a tweeter. As can readily be seen, the output signal y is even with a pulsed input signal x below a given threshold.

The circuit shown is not only applicable to dynamic loudspeakers but to most other types of loudspeakers and all other types of transducers that convert electrical power into mechanical power.

As set forth above, every loudspeaker can be assigned a nominal Power $P_N$ which is the power the loudspeaker can withstand permanently without experiencing any harm or destruction. However, the loudspeaker can also withstand a much higher power than the nominal Power $P_N$ depending on the time during which the loudspeaker is exposed to this higher power, known as peak power. Within certain limits, the peak power can be higher the shorter the duration of the peak is. Peaks exceeding the nominal Power $P_N$ are called "overshoots" and ensure a good acoustic performance of the loudspeaker because otherwise, if the peaks are simply cut off, (as shown in the example of FIG. 4), they limit the power too much, causing the dynamics of the signal to suffer. In order to achieve an acoustically pleasant limiting, a (single) compressor/limiter stage is disclosed herein during which, when controlled by the compressor/limiter and under certain circumstances, certain overshoots are allowed. The compressing/limiting of the overshoots depends on the type of loudspeaker used, the loudspeaker being characterized by, e.g., its nominal power $P_N$ and its lower critical frequency $f_L$, or by a more general classification like woofer, midrange speaker or tweeter (on the basis of approximated or assumed lower critical frequencies). The overshoots are controlled by specifically adapting/adjusting the attack and release times $T_A$, $T_R$ to the specific type of loudspeaker to be protected. The control may be implemented in a single compressor/limiter stage.

Although various examples of realizing the invention have been disclosed, it will be apparent to those skilled in the art that various changes and modifications can be made which will achieve some of the advantages of the invention without departing from the spirit and scope of the invention. It will be obvious to those reasonably skilled in the art that other components performing the same functions may be suitably substituted. Such modifications to the inventive concept are intended to be covered by the appended claims.

What is claimed is:

1. A loudspeaker overload protection circuit that protects a loudspeaker connected to a signal source, the circuit comprises:

a compressor that is connected between a signal source and the loudspeaker, the compressor having a first input for receiving an input audio signal, a second input that receives a signal representing an estimated loudspeaker power consumption, a third input that receives a signal representing the nominal power of the loudspeaker, and applies a gain to the input audio signal and provides an output audio signal indicative thereof; and a power estimator connected as a feedback network between the output and the second input of the compressor to estimate, from the compressor output audio signal, the power consumed by the loudspeaker, the power estimator receiving a signal that represents voltage and/or current supplied to the loudspeaker and a parameter that represents an ohmic resistance of the loudspeaker; wherein the power estimator is configured to calculate power consumed by the loudspeaker from two of (i) the voltage supplied to the loudspeaker, (ii) the current supplied to the loudspeaker (iii) and a parameter representing the ohmic resistance of the loudspeaker, and to supply a signal representing the estimated loudspeaker power consumption to the compressor; and wherein the compressor attenuates its input audio signal when the signal representing the estimated loudspeaker power consumption exceeds the signal representing the nominal power of the loudspeaker, a time constant estimator that receives the signal representing the voltage and/or current supplied to the loudspeaker and/or a parameter representing the ohmic resistance or the nominal power of the loudspeaker, and a frequency signal value, and provides two compressor time constants;

a timing unit that receives the two compressor time constants and adjusts or adapts an attack time and a release time of the compressor according to the two compressor time constants, where the time constant estimator and the timing unit selectively operate in a first mode of operation and a second mode of operation to control gain of the compressor in response to the input signal or the output signal, where a first adaptive control characteristic or a fixed control characteristic is applied in the first mode of operation and a second adaptive control characteristic is applied in the second mode of operation, a first unit that determines an excess value of the signal level of the input audio signal or the output audio signal over a threshold signal level; and a second unit that sets an attack time parameter to a fixed value if the excess value is above a first certain value and that sets the attack time parameter to a value dependent on the excess value, if the excess value is above a second certain value, where the first certain value is different from the second certain value.

2. The circuit of claim 1, further comprising a smoothing filter connected between the power estimator and the second input of the compressor.

3. The circuit of claim 1, where the first adaptive control characteristic is dependent on a signal level of the input audio signal and the fixed control characteristic is independent of the signal level.

4. The circuit of claim 1, where the second adaptive control characteristic is dependent on a release time parameter in the second mode of operation.

5. The circuit of claim 1, where the time constant estimator and the timing unit are cooperatively configured to set a release time parameter dependent on a signal level.

6. The circuit of claim 5, where the first adaptive control characteristic depends on an attack time parameter in the first mode of operation.

7. The circuit of claim 1, where the time constant estimator is a signal processing unit that processes the signal according to a given function or a table stored in memory.

8. A loudspeaker overload protection method for protecting a loudspeaker that is connected to a signal source, the method comprises:

receiving at a compressor a signal indicative of estimated loudspeaker power consumption;

receiving at the compressor a signal indicative of nominal power of the loudspeaker;

receiving at the compressor an input audio signal from the signal source and applying a gain to the input audio signal and providing an output audio signal indicative therefore to the loudspeaker;

estimating power consumed by the loudspeaker from two of (i) voltage supplied to the loudspeaker and providing a loudspeaker voltage signal indicative thereof, (ii) current supplied to the loudspeaker and providing a loudspeaker current signal indicative thereof (iii) and a parameter representing an ohmic resistance of the loudspeaker and providing an estimated loudspeaker power consumption signal;

attenuating with the compressor the input audio signal when the estimated loudspeaker power consumption signal exceeds the signal representing the nominal power of the loudspeaker;

providing, via a time constant estimator, two compressor time constants;

adjusting an attack time and a release time of the compressor according to the two compressor time constants;

selectively operating in a first mode of operation and a second mode of operation to control the gain of the compressor in response to the output audio signal, where a first adaptive control characteristic or a fixed control characteristic is applied in the first mode of operation and a second adaptive control characteristic is applied in the second mode of operation;

providing the output audio signal representing the input audio signal amplified by an initial gain value;

determining a signal level of the input audio signal or the audio output signal and comparing the signal level with a threshold level;

if the signal level is below the threshold level, updating the initial gain value using the second adaptive control characteristic; and if the signal level is above the threshold level, updating, dependent on the signal level, the initial gain value using a fixed control characteristic or the first adaptive control characteristic respectively; where:

the first adaptive control characteristic is dependent on the signal level and the fixed control characteristic is independent from the signal level.

9. The method of claim 8, further comprising smoothing the signal that represents the estimated loudspeaker power consumption.

10. The method of claim 8, further comprising providing at least one of the two compressor time constants in response to a received frequency signal.

11. The method of claim 10 where the at least one of the two compressor time constants is determined based upon one of a given function or a table stored in memory.

* * * * *